US009435524B2

(12) United States Patent
Athalye

(10) Patent No.: US 9,435,524 B2
(45) Date of Patent: Sep. 6, 2016

(54) LIQUID COOLED LED SYSTEMS

(75) Inventor: Praneet Athalye, Morrisville, NC (US)

(73) Assignee: Cree, Inc., Durham, NC (US)

( * ) Notice: Subject to any disclaimer, the term of this patent is extended or adjusted under 35 U.S.C. 154(b) by 565 days.

(21) Appl. No.: 13/453,577

(22) Filed: Apr. 23, 2012

(65) Prior Publication Data

US 2013/0170176 A1 Jul. 4, 2013

Related U.S. Application Data

(63) Continuation-in-part of application No. 13/340,928, filed on Dec. 30, 2011.

(51) Int. Cl.
*F21V 29/56* (2015.01)
*F21V 29/00* (2015.01)
(Continued)

(52) U.S. Cl.
CPC ..... *F21V 29/004* (2013.01); *F21K 9/135* (2013.01); *F21K 9/137* (2013.01); *F21K 9/56* (2013.01); *F21K 9/90* (2013.01); *F21V 3/00* (2013.01); *F21V 3/0481* (2013.01); *F21V 29/006* (2013.01); *F21V 29/56* (2015.01); *F21V 29/58* (2015.01); *F21V 21/30* (2013.01);
(Continued)

(58) Field of Classification Search
CPC .... F21V 29/20; F21V 29/2293; F21V 29/30; F21V 29/24; F21V 29/248; F21V 29/006; F21V 29/004; F21V 29/51; F21V 29/56; F21V 29/402; F21Y 2101/02; F21K 9/135
USPC ..... 362/294, 373, 218, 547, 267
See application file for complete search history.

(56) References Cited

U.S. PATENT DOCUMENTS 4,047,069 A * 9/1977 Akutsu et al. ..... 313/487
6,639,360 B2 10/2003 Roberts et al.
(Continued)

FOREIGN PATENT DOCUMENTS

EP 2108880 A2 10/2009
FR 2926926 A1 * 7/2009
(Continued)

OTHER PUBLICATIONS

Cree, Inc., International Application No. PCT/US2012/070499, International Search Report and Written Opinion, Apr. 3, 2013.
(Continued)

*Primary Examiner* — Robert May
(74) *Attorney, Agent, or Firm* — Steven B. Phillips; Moore & Van Allen PLLC

(57) ABSTRACT

Liquid cooled LED systems are disclosed. Embodiments of the invention provide an LED lighting system in which the LED devices are cooled by circulating liquid or fluid. In example embodiments, a flow return member provides a way for a fluid medium to enter and exit an envelope containing the LED devices. An additional cooling mechanism, such as a radiator or thermoelectric cooler can be provided. The optically transmissive fluid medium can be, for example, oil or a fluorinated or halogenated liquid or gel, and can optionally provide index matching. The fluid medium can optionally include a phase change material in order to enhance cooling. In some embodiments, a pump is used to circulate the fluid medium. However, the optical envelope and/or the flow return member could also be oriented so that the fluid medium circulates by gravity and/or temperature difference.

29 Claims, 9 Drawing Sheets

(51) Int. Cl.

| | |
|---|---|
| ***F21V 3/00*** | (2015.01) |
| ***F21K 99/00*** | (2016.01) |
| ***F21V 3/04*** | (2006.01) |
| ***F21V 29/58*** | (2015.01) |
| *F21Y 101/02* | (2006.01) |
| *F21Y 111/00* | (2016.01) |
| *F21Y 113/00* | (2016.01) |
| *F21V 21/30* | (2006.01) |
| *F21V 29/506* | (2015.01) |

(52) U.S. Cl.

CPC ..... *F21V 29/506* (2015.01); *F21Y 2101/02* (2013.01); *F21Y 2111/001* (2013.01); *F21Y 2113/005* (2013.01)

(56) References Cited

U.S. PATENT DOCUMENTS

| | | | | |
|---|---|---|---|---|
| 6,744,194 | B2 | 6/2004 | Fukasawa et al. | |
| 6,888,173 | B2 | 5/2005 | Ishii et al. | |
| 7,063,996 | B2 | 6/2006 | Ishii et al. | |
| 7,141,442 | B2 | 11/2006 | Sano | |
| 7,213,940 | B1 | 5/2007 | Van De Ven et al. | |
| 7,453,195 | B2 * | 11/2008 | Radkov | 313/487 |
| 7,819,556 | B2 * | 10/2010 | Heffington et al. | 362/294 |
| 8,008,845 | B2 | 8/2011 | Van De Ven et al. | |
| 8,547,002 | B2 * | 10/2013 | Lenk | F21V 29/248 313/46 |
| 8,789,973 | B2 * | 7/2014 | Li | 362/294 |
| 8,967,825 | B2 * | 3/2015 | Fukui | 362/218 |
| 2004/0201990 | A1 | 10/2004 | Meyer | |
| 2007/0267976 | A1 | 11/2007 | Bohler et al. | |
| 2009/0184618 | A1 | 7/2009 | Hakata et al. | |
| 2010/0109551 | A1 | 5/2010 | Shen | |
| 2010/0219734 | A1 | 9/2010 | Lenk | |
| 2010/0253226 | A1 * | 10/2010 | Oki | 315/113 |
| 2011/0074270 | A1 | 3/2011 | Van De Ven et al. | |
| 2011/0074296 | A1 * | 3/2011 | Shen et al. | 315/112 |
| 2011/0176316 | A1 | 7/2011 | Phipps et al. | |
| 2011/0193479 | A1 | 8/2011 | Nilssen et al. | |
| 2012/0040585 | A1 | 2/2012 | Huang | |

FOREIGN PATENT DOCUMENTS

| | | | | |
|---|---|---|---|---|
| FR | 2926947 | A1 * | 7/2009 | |
| GB | 365740 | A * | 1/1932 | F21V 29/56 |
| TW | 201111692 | A | 4/2011 | |
| WO | 2007130359 | A2 | 11/2007 | |
| WO | 2011097486 | A2 | 8/2011 | |
| WO | 2011109093 | A1 | 9/2011 | |
| WO | 2012011279 | A1 | 1/2012 | |
| WO | 2012031533 | A1 | 3/2012 | |

OTHER PUBLICATIONS 3M, 3M Fluorinert Electronic Liquids, http://solutions.3m.com/wps/porta1/3M/en_US/ElectronicsChemicals/Home/Products/ElectronicLiquids/, accessed Dec. 6, 2011.

U.S. Appl. No. 13/235,103, filed Sep. 16, 2011.

U.S. Appl. No. 13/235,127, filed Sep. 16, 2011.

Chinese Patent Office; Chinese Office Action for Chinese Application No. 201280071001.4 dated Jun. 19, 2015, 13 Pages.

* cited by examiner

LIQUID COOLED LED SYSTEMS

CROSS-REFERENCE TO RELATED APPLICATION

This application is a continuation-in-part of and claims priority from commonly owned, co-pending application Ser. No. 13/340,928, filed Dec. 30, 2011, now U.S. Patent Application Publication No. 2013/0170175, the entire disclosure of which is incorporated herein by reference.

BACKGROUND

Light emitting diode (LED) lighting systems are becoming more prevalent as replacements for existing lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

LED units often include some type of optical element or elements to allow for localized mixing of colors, collimate light, or provide a particular light pattern. Sometimes the optical element also serves as an envelope or enclosure for the electronics and/or the LEDs. A power supply can be included in the system along with the LEDs or LED packages and the optical components. The heat generated by the LEDs can raise the temperature of the power supply components, and/or vice versa, and the resulting temperature increase must be taken into account in the system design. A heatsink, heat pipe and/or other heat removal or dissipation elements are also often needed to cool the LEDs and/or power supply in order to maintain appropriate operating temperature for the LEDs and any other electronics in the system.

SUMMARY

Embodiments of the present invention provide an LED lighting system in which the LED devices are cooled by circulating liquid or fluid. In example embodiments, a flow return member provides a way for a fluid medium to enter and exit an envelope containing the LED devices. In at least some embodiments, an additional cooling mechanism, such as a radiator or thermoelectric cooler can be provided. Embodiments of the invention can use an LED array of various configurations and shapes, although some embodiments can be most readily used with linear LED lighting systems and fixtures. Such linear arrays might be used, for example, in decorative lighting, or to replace the tubular bulbs sometimes used in xenon directional lamps.

A lighting system according to some embodiments of the invention includes an optically transmissive envelope and an array of LED devices disposed in the optically transmissive envelope to be operable to emit light when energized. The envelope can include an optically transmissive fluid medium in thermal communication with the array of LED devices. A flow return member is disposed to be in fluid communication with the optically transmissive envelope so that the optically transmissive fluid medium can circulate through the optically transmissive envelope. In some embodiments, an additional internal envelope can be provided between the optically transmissive envelope and the array of LED devices. This internal envelope can contain an internal coolant, which can be of the same or a different make up as the optically transmissive fluid and may or may not be circulating.

In some embodiments, additional cooling for the lighting system can be provided by a radiator such as a collection of cooling coils or some other passive structure. In some embodiments, additional cooling can be provided by a thermoelectric cooler such as a Peltier device in thermal communication with the optically transmissive fluid medium. The optically transmissive fluid medium can be, for example, oil or a fluorinated or halogenated liquid or gel, and can optionally provide index matching. The fluid medium can optionally include a phase change material in order to enhance cooling. In some embodiments, a pump is used to circulate the fluid medium. In some embodiments the envelope and/or the flow return member is/are oriented so that the fluid medium circulates by gravity and/or temperature difference.

In some embodiments of the invention, a phosphor or phosphors can be used within or on the optical envelope to improve the color rendering index of the light from the system. Such a phosphor, for example, can be applied to an individual LED dies, can be applied to or dispersed in the envelope material, or can be suspended in the fluid medium. The optical envelope of the lighting system can also optionally act as a notch filter. In some embodiments, a spectral notch can be produced by the notch filter, where the notch occurs between 520 nm and 605 nm in the visible spectrum of visible light.

In some embodiments of the invention, the array of LED devices may include a plurality of LED devices connected in series. The devices can be configured to use direct or alternating current. In some embodiments, the array of LED devices includes a plurality of LED devices connected in parallel. In either case, an LED device may be or include an individual LED chip, or may be a multichip device either with or without a submount or other carrier. The LED chips may be encapsulated or may be directly in contact with the fluid medium. In embodiments where a parallel electrical connection is used, the flow return member and optically transmissive envelope of the lighting system can be configured so that the optically transmissive fluid medium circulates in a direction that opposes a voltage drop through the plurality of connected LED devices. Such a configuration can enable the effects of the temperature increase in the fluid as it absorbs heat from the LED devices to at least in part balance out the effects of the voltage drop in a linear array of LED devices.

A lighting system according to example embodiments of the invention may find use in any of various light fixtures with a power supply and a reflector or other optical elements as appropriate. As an example, a lighting system according to an embodiment of the invention with a tubular optical envelop and/or a linear array of LED devices could be used in a flood or spot self-contained light fixture such as the type used in commercial architectural lighting or theatrical lighting. In such a case, the linear light source of the lighting system of an embodiment of the invention can replace the xenon tubular bulb that would otherwise be used, while the reflector design and overall form factor of the fixture could be maintained. Whether the lighting system is used in such a fixture, or in some other application, in operation the LEDs are energized and the optically transmissive fluid is passed through the optical envelope surrounding the LED array. Provision can be made for dissipating the heat from the optically transmissive fluid. Traditional versions of the flood or spot fixtures mentioned sometimes include a structure for dissipating heat, which could be used to house the radiator or thermoelectric cooler previously mentioned.

BRIEF DESCRIPTION OF THE DRAWINGS

FIG. 9 is presented with two views designated FIG. 9A and FIG. 9B.

DETAILED DESCRIPTION

Figure 1:
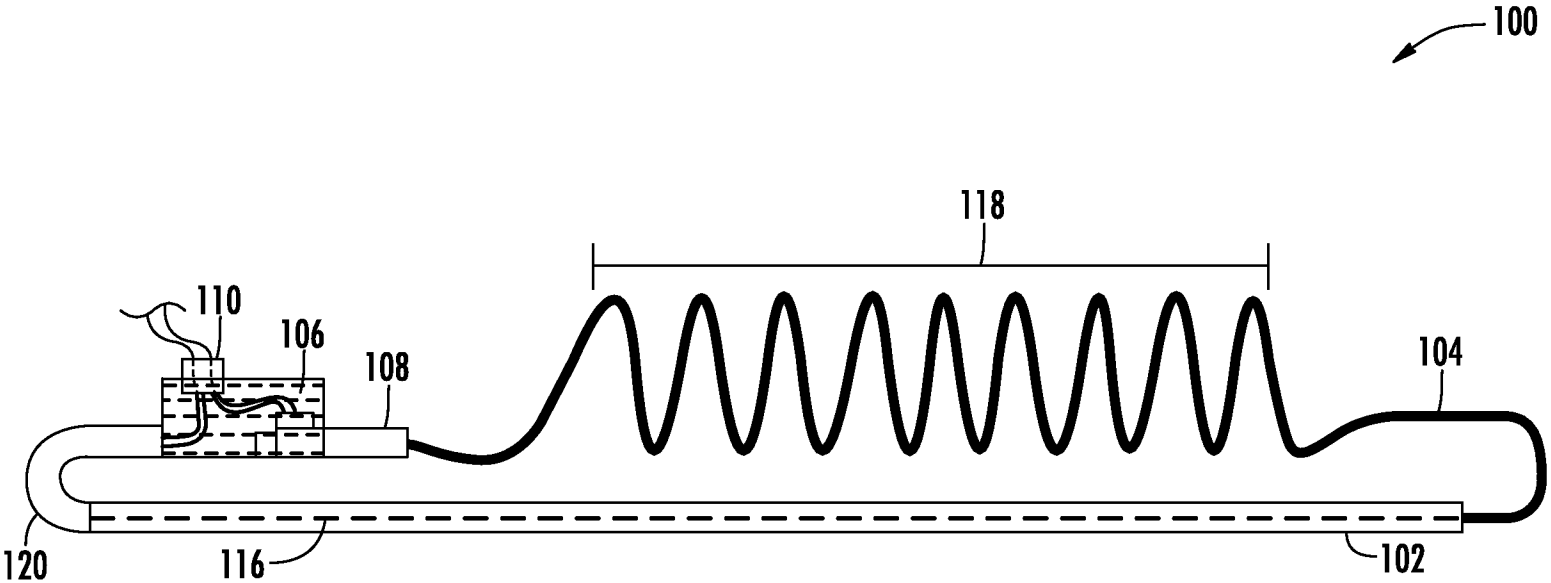
FIGS. 1-4 illustrate various examples of a lighting system according to example embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein. Unless otherwise expressly stated, comparative, quantitative terms such as "less" and "greater", are intended to encompass the concept of equality. As an example, "less" can mean not only "less" in the strictest mathematical sense, but also, "less than or equal to."

Embodiments of the present invention provide an LED lighting system in which the LED devices are cooled by circulating, optically transmissive fluid medium. In example embodiments, a flow return member provides a way for a fluid medium to enter and exit an optically transmissive envelope containing the LED devices. In at least some embodiments, an additional cooling mechanism, such as a radiator or thermoelectric cooler can be provided. Embodiments of the invention can use an LED array of various configurations and shapes. Embodiments shown with linear LED lighting systems and/or fixtures are presented as examples only. Likewise, the optical envelope or enclosure can take various shapes, for example spherical or a flat rectangular shape. The optical envelope could also be designed with multiple entry and exit points for the coolant being used. It should also be noted that although the optically transmissive fluid can be said to be in thermal communication with the LED devices, this thermal communication could be either direct or indirect. In the indirect case, there could be other intervening structures or even an additional fluid-filled envelope through which heat passes.

In example embodiments of the invention, either or both of the fluid medium used for cooling, and the optical envelope through which the fluid medium circulates, may be described herein as optically transmissive. The phrase "optically transmissive" means that a large proportion of light passes through the material. The phrase does not necessarily imply transparency, although a transparent material in either case would certainly be considered optically transmissive. However, either or both of the fluid medium and the envelope (as well as other components) can be and should be considered optically transmissive if they are diffusive as well. In fact, in some applications, it is advantageous to provide a diffusive optical envelope and/or fluid for the LED devices to provide color mixing. Furthermore, these components are considered optically transmissive if they include a phosphor to provide wavelength conversion or partial wavelength conversion, since even if the emitted light has a different wavelength than the light incident on the material, light is still being transmitted.

FIG. 1 illustrates a lighting system according to some example embodiments of the invention. Lighting system 100 includes an optically transmissive envelope 102 and a flow return member 104. The optical envelope in this and other embodiments may be a flexible or rigid transparent or diffusive light transmissive vinyl, polymer, or glass. The flow return member in this example is made of metal. Reservoir 106 is provided to hold excess cooling liquid. Pump 108 is provided to cause the optically transmissive fluid to circulate through envelope 102 and flow return member 104. The circulating optically transmissive fluid is in thermal communication with the array of LED devices. Connector 110 in fluid reservoir 106 provides a power interface, with leads supplying power to pump 108 as well as an array of LED devices 116 shown schematically within optically transmissive envelope 102. The reservoir acts as a sealed terminal box that allows wiring to the system without leakage. Further details of possible configurations of LED devices will be discussed later in this disclosure, for example, with respect to FIGS. 6-8.

Still referring to FIG. 1, the flow return member also includes an additional cooling mechanism, radiator 118, which is in this embodiment, a series of metal coils through which the fluid medium passes. System 100 can include a power supply (not shown), which can be installed in the fluid reservoir or in pipe 120, which supplies the liquid to optical envelope 102. A small and efficient power supply could also be installed in the optical envelope. In many embodiments, the power supply can be cooled by the same circulating fluid medium that cools the LED devices. Alternatively, the system can operate from alternating current, or direct current supplied by an external source.

Figure 2:
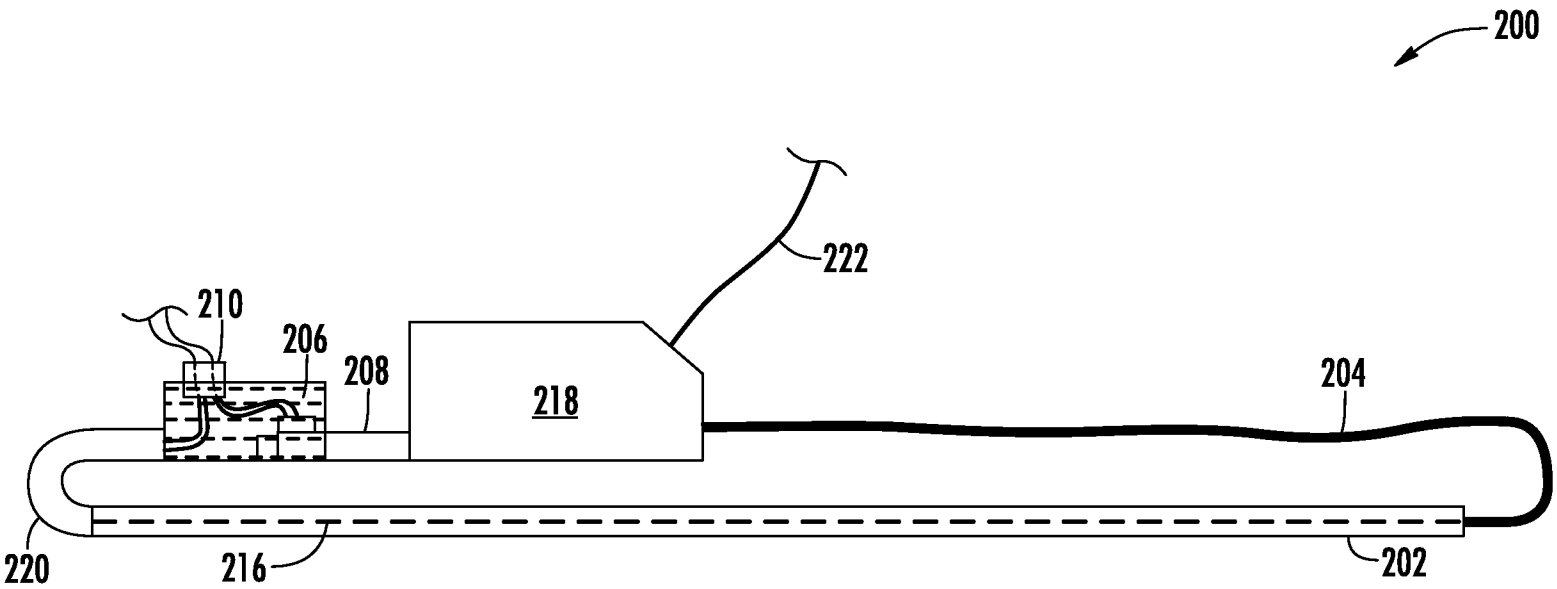

FIG. 2 illustrates a lighting system according to additional embodiments of the invention. Lighting system 200 includes optically transmissive envelope 202 and a flow return member 204. Reservoir 206 is again provided to hold excess optically transmissive fluid. Pump 208 circulates the fluid through envelope 202 and flow return member 204. Connector 210 in the fluid reservoir provides a power connection for the pump and the light source an array of LED devices 216. In the example of FIG. 2, the additional cooling mechanism 218 for the system can be any powered device or collection of devices, such as a fan and coil arrangement, a traditional HVAC-style cooling system, or a thermoelectric cooler such as a Peltier device installed between the flow return member and the pump. Pipe 220 connects the fluid reservoir to optical envelope 202. In this example, cooling mechanism 218 is connected to a power source through its own cable 222; however, power could alternatively be supplied through a passage to the reservoir 206 and connector 210. As before, the system can include a power supply, can be powered by line voltage, or be connected to a separate power supply. It should also be noted that where the cooling mechanism is an HVAC-style system, the refrigerant can be used as the optically transmissive fluid medium for the system.

Figure 3:
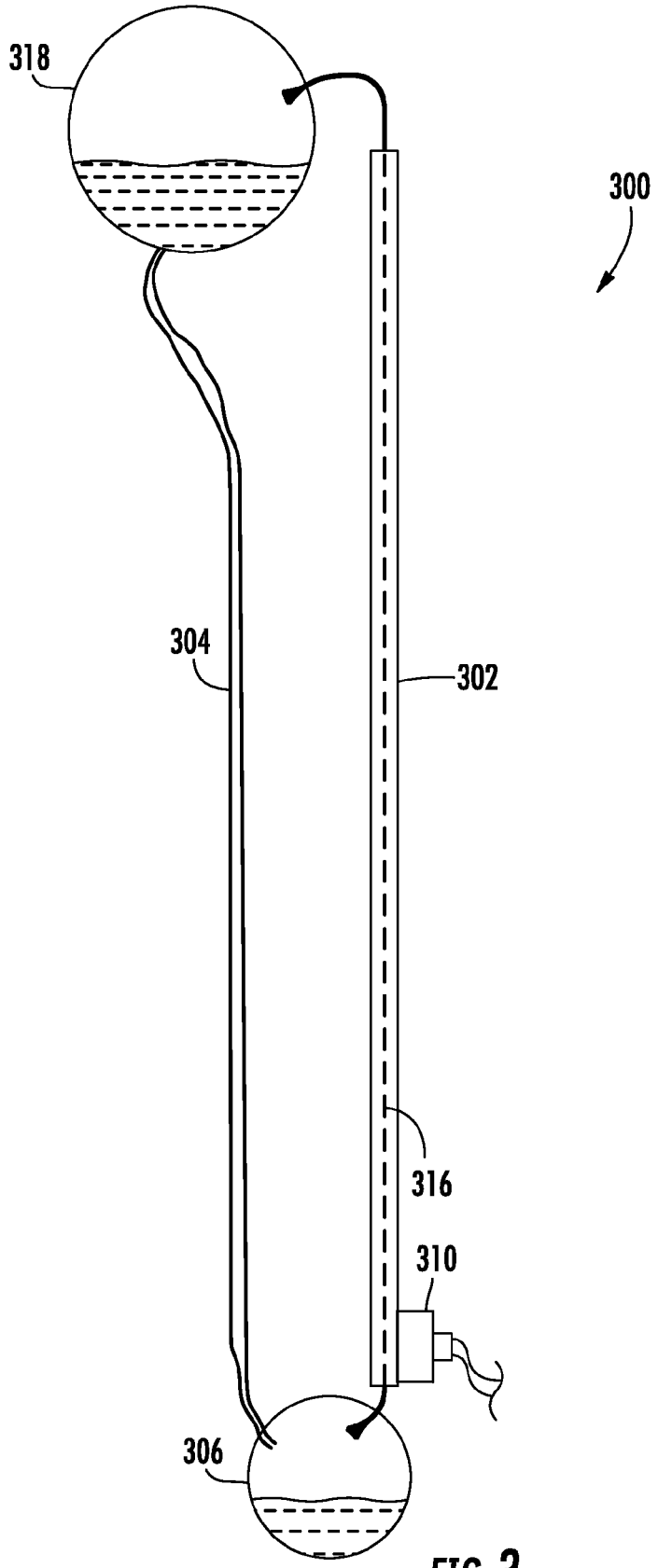

FIG. 3 illustrates a lighting system according to further embodiments of the invention. Lighting system 300 includes optically transmissive envelope 302 and a flow return member 304. In this embodiment, reservoir 306 is provided to accumulate optically transmissive fluid. However, in system 300, the optically transmissive fluid is or includes phase change material so that the system acts like a large heat pipe. The phase change provides additional cooling and drives the fluid to circulate through optical envelope 302 and the flow return member 304. Connector 310 provides a power connection for the LED devices 316 and in some embodiments includes a power supply or driver. Phase change occurs in condenser 318, where the fluid condenses into liquid, before dropping to reservoir 306 and circulating through the optical envelope, where it vaporizes or partially vaporizes from heat generated by the LED array. In example embodiments, the phase changes occur at the hottest point in the system and in the condenser regardless of the orientation of the lamp, thus the phase change material will provide cooling regardless of how the system is positioned.

Figure 4:
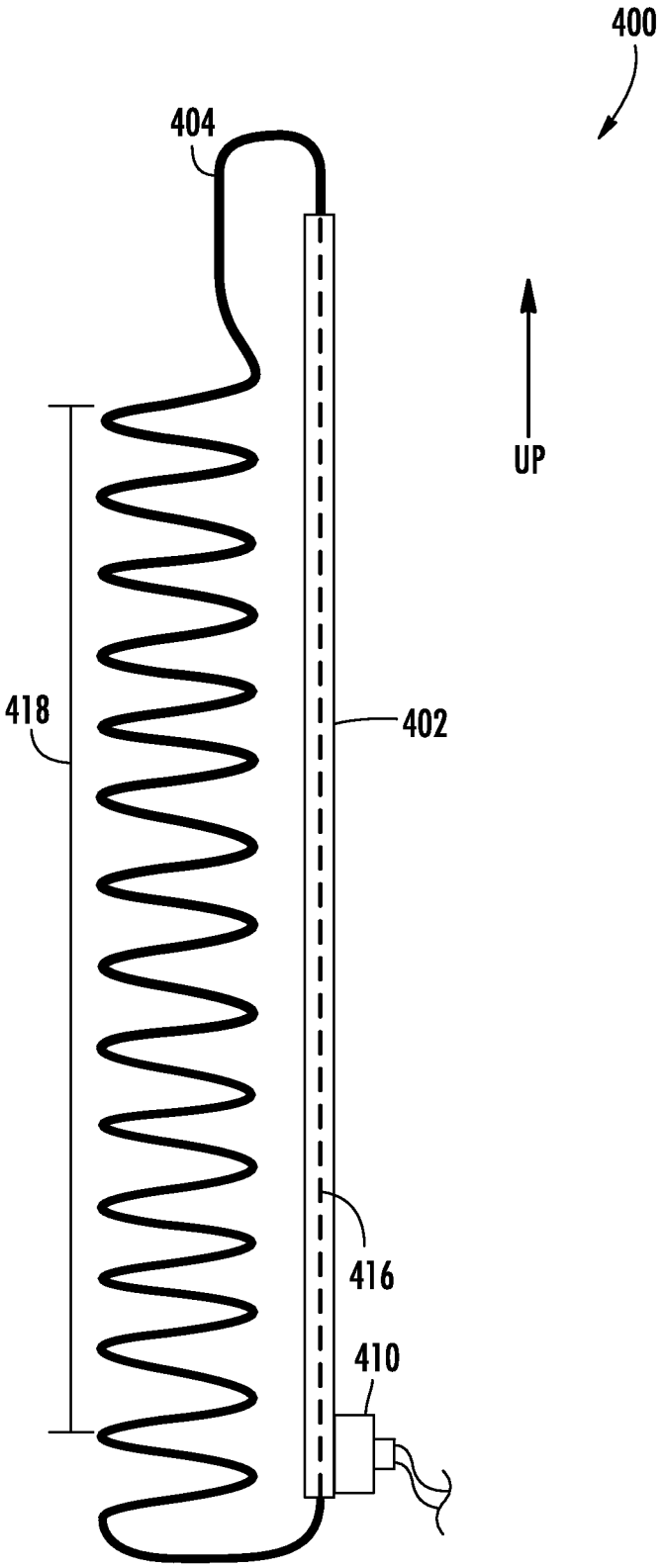

FIG. 4 illustrates a lighting system according additional embodiments of the invention. The system of FIG. 4 is similar to the system of FIG. 1 in most respects, except that there is no pump. In system 400 of FIG. 4, gravity, temperature difference and the closed nature of the system cause the optically transmissive fluid to circulate when the system is operated in the vertical position, as indicated in the drawing legend. Lighting system 400 includes optically transmissive envelope 402 and metal flow return member 404. Connector 410 provides a power connection for the LED devices 416 and in some embodiments includes a power supply or driver. In the example of FIG. 4, the flow return member again includes an additional cooling mechanism, radiator 418, which is again in this embodiment, a series of metal coils through which the fluid medium passes.

In some embodiments of the invention, it may be desirable to confine any power supply to a relatively small space, inside the fluid reservoir or a connecting tube for example. Various methods and techniques can be used to increase the capacity and decrease the size of a power supply, also sometimes called a "driver," in order to allow the power supply for an LED lamp to be manufactured more cost-effectively, or to take up less space. For example, multiple LED devices used in series can be configured to be powered with a relatively high voltage. Additionally, energy storage methods can be used in the driver design. For example, current from a current source can be coupled in series with LEDs, a current control circuit and a capacitor to provide energy storage. A voltage control circuit can also be used. A current source circuit can be used together with a current limiter circuit configured to limit a current through the LEDs to less than the current produced by the current source circuit. In the latter case, the power supply can also include a rectifier circuit having an input coupled to an input of the current source circuit.

Some embodiments of the invention can include a multiple LED sets coupled in series. One set of LEDs, for example, may be included on each of several submount-based devices that make up the LED array used in the liquid-cooled system. The power supply in such an embodiment can include a plurality of current diversion circuits, respective ones of which are coupled to respective nodes of the LED sets and configured to operate responsive to bias state transitions of respective ones of the LED sets. Such circuits can be installed with sets of LEDs on submounts or be wired between devices in a linear array. In some embodiments, a first one of the current diversion circuits is configured to conduct current via a first one of the LED sets and is configured to be turned off responsive to current through a second one of the LED sets. The first one of the current diversion circuits may be configured to conduct current responsive to a forward biasing of the first one of the LED sets and the second one of the current diversion circuit may be configured to conduct current responsive to a forward biasing of the second one of the LED sets.

In some of the embodiments described immediately above, the first one of the current diversion circuits is configured to turn off in response to a voltage at a node. For example a resistor may be coupled in series with the sets and the first one of the current diversion circuits may be configured to turn off in response to a voltage at a terminal of the resistor. In some embodiments, for example, the first one of the current diversion circuits may include a bipolar transistor providing a controllable current path between a node and a terminal of a power supply, and current through the resistor may vary an emitter bias of the bipolar transistor. In some such embodiments, each of the current diversion circuits may include a transistor providing a controllable current path between a node of the sets and a terminal of a power supply and a turn-off circuit coupled to a node and to a control terminal of the transistor and configured to control the current path responsive to a control input. A current through one of the LED sets may provide the control input. The transistor may include a bipolar transistor and the turn-off circuit may be configured to vary a base current of the bipolar transistor responsive to the control input.

With any of the examples discussed, the system operates by energizing an LED array, possibly using a power supply like that described above, and circulating the optically transmissive fluid through an envelope surrounding the LED array and possibly also surrounding the power supply circuitry. In some embodiments, phosphor is energized along with the appropriate LED chips. A flow return member is used to move the fluid out of one end of the optical envelope of the system and into the other end. It should be noted however that the optical envelop could take various shapes. Thus the terms "one end" and "the other end" are used only in reference to the entry points and exit points of fluid, which serves as a coolant. As previously mentioned, additional mechanisms to dissipate heat from the fluid as it circulates can be employed. Such an additional mechanism can be used to radiate the heat from the fluid. A thermoelectric cooler can be used to cool the fluid. Phase change of the fluid material can be used. Two or more of these mechanisms can be combined.

With respect to the fluid medium used with an embodiment of the invention, as an example, a liquid, gas, gel, or other material that is either moderate to highly thermally conductive, moderate to highly convective, or both, can be used. As previously mentioned, the fluid medium can be a refrigerant such as any of those used in residential or commercial HVAC and refrigeration systems. Any or all of these can generically be referred to as either a fluid or a liquid. As used herein, a "gel" includes a medium having a solid structure and a liquid permeating the solid structure. A gel can include a liquid, which is a fluid. The term "fluid medium" is used herein to refer to gels, liquids, and any other formable material. The fluid medium surrounds the LED devices in the optical enclosure. In example embodiments, the fluid medium is nonconductive enough so that no packaging or insulation is needed for the LED devices, although packaging may be included. In example embodiments, the fluid medium has low to moderate thermal expansion, or a thermal expansion that substantially matches that of one or more of the other components of the system. The fluid medium in at least some embodiments is also inert and does not readily decompose. A fluid medium can be any continuous, amorphous substance whose molecules move freely past one another and that has the tendency to assume the shape of its container. In addition to a liquid, a fluid medium can be a gas such as helium.

As examples, the fluid medium used in some embodiments of the invention can be oil. The oil can be petroleum-based, such as mineral oil, or can be organic in nature, such as vegetable oil. The fluid medium in some embodiments may also be a perfluorinated polyether (PFPE) liquid, or other fluorinated or halogenated liquid, or gel. An appropriate propylene carbonate liquid or gel having at least some of the above-discussed properties might also be used. Suitable PFPE-based liquids are commercially available, for example, from Solvay Solexis S.p.A of Italy. In embodiments where a phase change material is used for the fluid medium chloromethane, alcohol, methylene chloride or trichloromonofluoromethane can be used. Flourinert™ manufactured by the 3M Company in St. Paul, Minn., U.S.A. can be used as coolant and/or a phase change material. It should also be noted that water could be used as a phase change material, since pressure inside the relevant portion of lamp can be reduced in order to reduce the phase change temperature for water.

In at least some embodiments, the optically transmissive fluid medium is an index matching medium that is characterized by a refractive index that provides for efficient light transfer with minimal reflection and refraction from the LEDs through the enclosure. The index matching medium can have the same or a similar refractive index as the material of the optical envelope, the LED device package material or the LED substrate material. The index matching medium can have a refractive index that is arithmetically in between the indices of two of these materials.

As an example, if unpackaged LED chips are used for the LED devices of the LED array, a fluid with a refractive index between that of the LED substrates and the enclosure and/or inner envelope can be used. LEDs with a transparent substrate can be used so that light passes through the substrate and can be radiated from the light emitting layers of the chips in all directions, assuming the LED chips are on a lead frame structure without submounts. If the substrate chosen is silicon carbide, the refractive index of the substrates is approximately 2.6. If glass is used for the enclosure or envelope, the glass would typically have a refractive index of approximately 1.5. Thus a fluid with a refractive index of approximately 2.0-2.1 could be used as the index matching fluid medium. LEDs with a sapphire substrate can also be used. Since the substrate in this case would be an insulator, an ohmic contact would need to pass through the substrate of the LED if an un-packaged die is used. However, the refractive index of sapphire is approximately 1.7, so that in this case if glass is again used for the enclosure or envelope, the fluid medium could have a refractive index of approximately 1.6. If glass lenses are used on packaged LED devices, the fluid could have an index of approximately 1.5, essentially matching that of both the lenses and the optical envelope.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die. For example, blue-shifted yellow (BSY) LED devices, which typically include a local phosphor, can be used with a red phosphor on or in the optically transmissive envelope to create substantially white light, or combined with red emitting LED devices in the array to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm.

As another example, blue or violet LEDs can be used in a lighting system and the appropriate phosphor can be included in any of the ways mentioned. LED devices can be used with phosphorized coatings packaged locally with the LEDs or with a phosphor coating the LED die. A lighting system that produces warm white or cool white light can make use of two phosphors, for example, calcium silicon nitride (CAS) red phosphor and/or yttrium aluminum garnet (YAG) yellow phosphor. These phosphors can be excited by blue LEDs by including one and/or both phosphors in LED packages, on the LED die, in the fluid as well as in or on the optical envelope of the system.

In some embodiments, if LED components that produce warm white light are used for the LED array, the optical envelope of s system according to embodiments of the invention can be made to notch filter the light from the LED array to improve the color rendering capability of the system. As an example, a rare earth compound such as neodymium oxide can be used in or on the optical envelope. Due to the neodymium oxide or other rare earth element in or on the optical envelope, light passing through this optical element is filtered so that the light exiting the optical envelope exhibits a spectral notch. In some embodiments, the rare earth compound can be any or a combination of neodymium oxide, didymium, dysprosium, erbium, holmium, praseodymium and thulium. A spectral notch is a portion of the color spectrum where the light is attenuated, thus forming a "notch" when light intensity is plotted against wavelength. Depending on the type or composition of glass or other material used to form the optical envelope, the amount of rare earth compound present, and the amount and type of other trace substances in the optical element, the spectral notch can occur between the wavelengths of 520 nm and 605 nm. In some embodiments, the spectral notch can occur between the wavelengths of 565 nm and 600 nm. In other embodiments, the spectral notch can occur between the wavelengths of 570 nm and 595 nm. Warm white light created by a combination of LEDs and/or phosphor may be either oversaturated with certain colors. In such systems, notch filtering can be used to alleviate oversaturation, thereby improving the CRI of the system.

Figure 5:
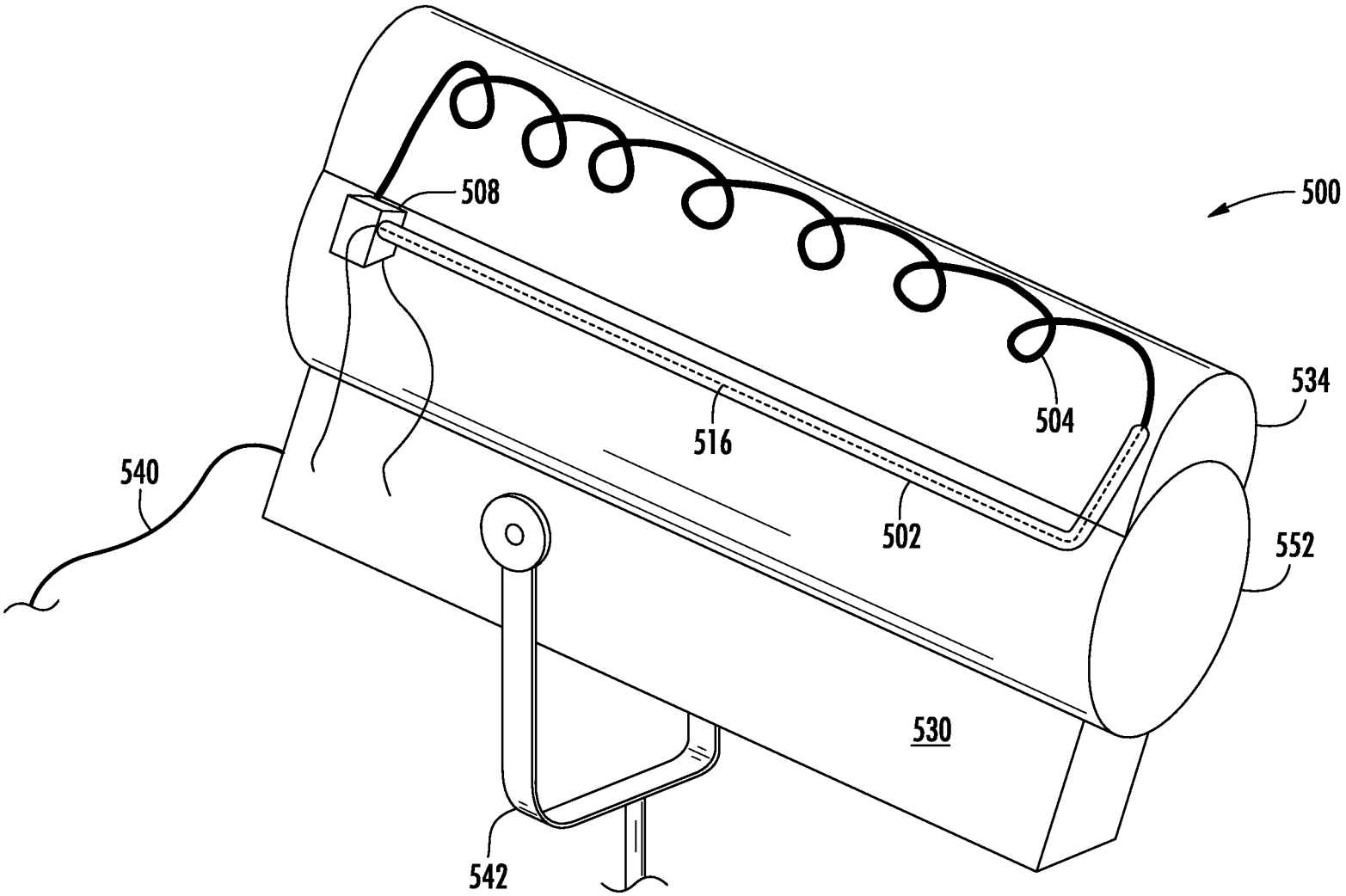
FIG. 5 illustrates a light fixture making use of a system according to example embodiments of the invention.

FIG. 5 illustrates a light fixture 500 according to an example embodiment of the invention. Light fixture 500 makes use of a linear LED array and optical envelope to create a spot light of the type that might find use in theatrical applications. The linear LED light source can serve as a replacement for the typical tubular xenon bulb used in such applications. Linear optical envelope 502 and a metal flow return member 504 circulate optically transmissive liquid coolant. Reservoir 508 includes a pump (not shown) provided to cause optically transmissive liquid to circulate through envelope 502 and flow return member 504. The flow return member includes a series of metal coils through which the fluid medium passes. An array of LED devices 516 is shown schematically within optically transmissive envelope 502. Since the light source for fixture 500 needs to be omnidirectional about the central axis of the tubular optical envelope, bare, transparent LED dies are used on a wire frame structure. Some dies are coated with a phosphor and the optical envelope is frosted or otherwise textured to be diffusive and provide appropriate color mixing.

Still referring to FIG. 5, fixture 500 includes a sheet steel enclosure with three portions. Enclosure portion 530 includes the power supply for the system as well as control circuitry (not shown). Enclosure portion 552 includes various optical elements (not visible). For example, enclosure portion 552 includes a reflector to direct the light out the front of the fixture and produce a narrow beam of light. Typically, other optical elements are present in portion 552 to allow the beam of light produced to be soft or hard edges, to insert color filters into the light path, and to adjust the beam angle and relative size of the spot formed by the beam. Enclosure portion 534 provides a cosmetic shield for the radiator for the liquid cooled LED lighting system and includes slots or holes to allow heat to escape. Fixture 500 may optionally include a fan to aid in cooling. Fixture 500 is powered by line cord 540 and supported by an alt-azimuth stand, 542.

Figure 6:
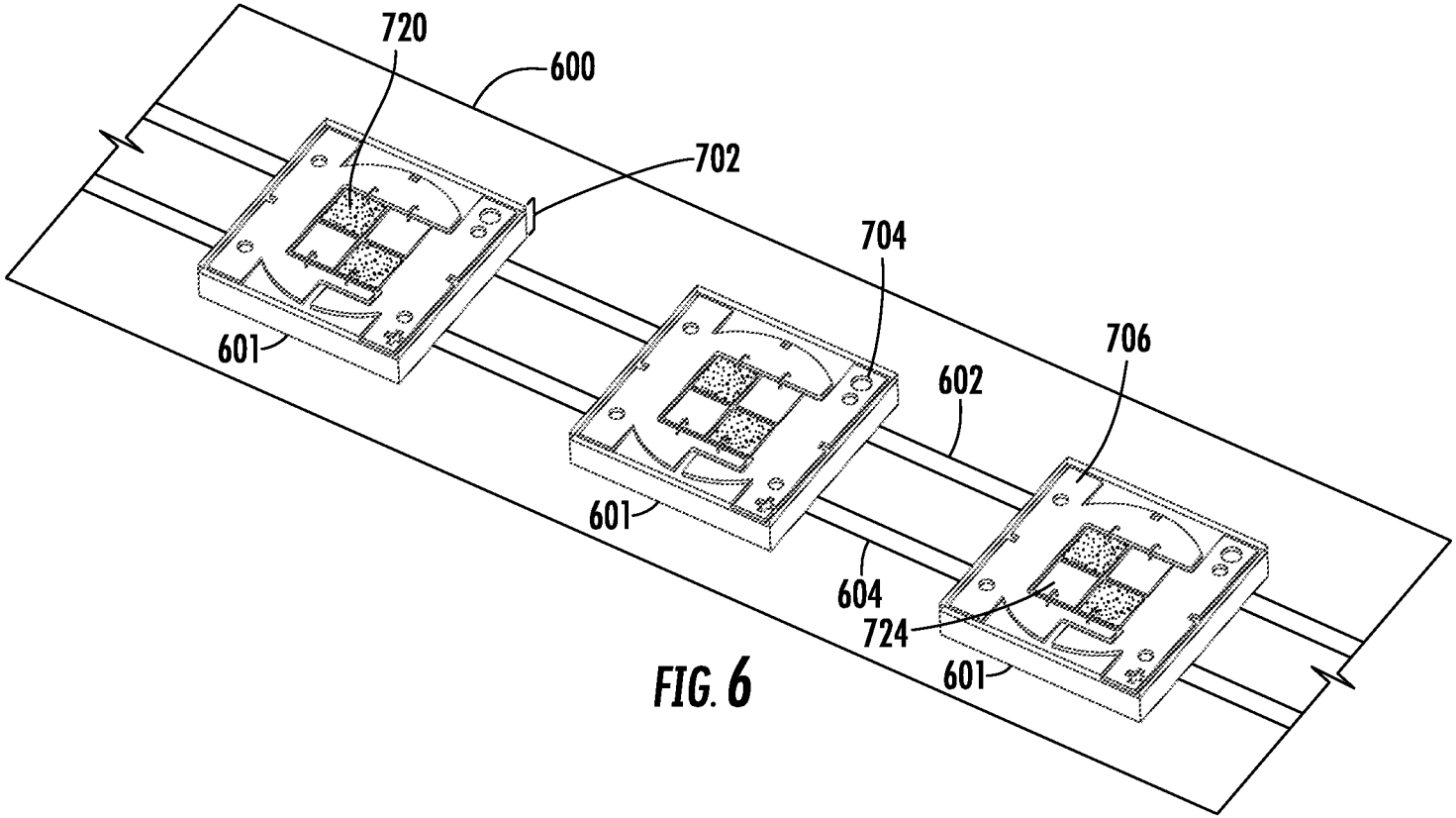
FIGS. 6 and 7 provide magnified views of a linear array of LED devices connected in series and disposed within an optical envelope according to example embodiments of the invention.

FIG. 6 shows a top perspective view of a portion of a tubular optical envelope 600 with a plurality of LED devices 601 included inside. The optical envelope is full of circulating liquid as previously described. Three LED devices are shown in this part of the optical envelope. In this particular example, all of the LEDs face the same direction, though as mentioned elsewhere a system can be designed in which the LEDs face different directions. The LED devices receive power through metal strips 602 and 604, wherein strip 602 is a return lead, to which the devices do not connect but are mechanically secured, and strip 604 provides for a series connection of the devices.

Still referring to FIG. 6, LED devices 601 in this example embodiment makes use of submounts 702 and each include four interconnected LED chips on metal layer portion 704 of the submount. The anodes of the LED chips are on the bottom of the chips in this view and are in contact with metal layer portion 704, which is in turn connected to the positive terminal of the device. The cathodes of the LED chips are connected by wire bonds to metal layer portion 706, which is in turn connected to the negative terminal of the device. This arrangement allows the plurality of LED chips to be placed close together and be relatively small but still have relatively high efficiency and output. LED devices 601 could optionally include a lens, however in this embodiment they are simply surrounded by the liquid within optical envelope 600.

Continuing with FIG. 6, the LED chips of devices 601 may be selected from various light color bins to provide a combined light output with a high color rendering index (CRI). The desired color mixing may be achieved, for example, using blue, green, amber, red and/or red-orange LED chips. In the Example of FIG. 6, LED chips 720 are coated or painted with a phosphor and LED chips 724 are not. The optical envelope 600 includes color mixing treatment (not shown for clarity) by way of texturing or frosting to cause the optical envelope to be diffusively light transmissive.

Figure 7:
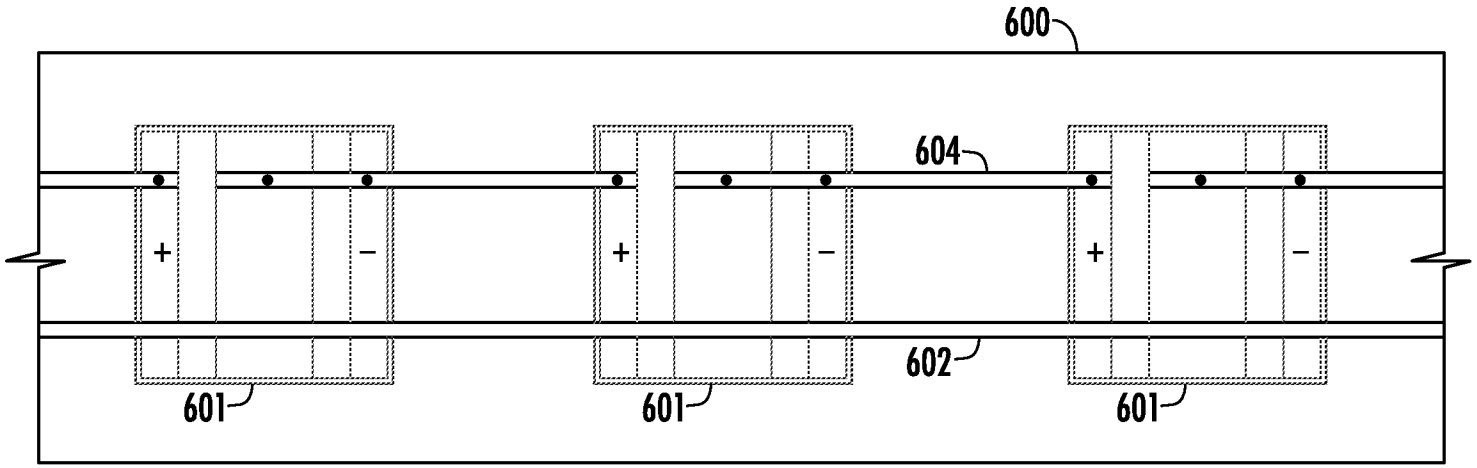

FIG. 7 presents a bottom view of the LED light source and optical element portion illustrated in FIG. 6. The positive and negative supply terminals of devices 601 are indicated on the drawing. Strip 602 serves as a supply return lead and makes no connection to devices 601, but provides mechanical stability. The devices can be fastened to this lead by adhesive, or in any other way. Lead 604 supplies power and interconnects devices 601 in series, as can be appreciated by observing the connection dots on each device, the middle dot being included primarily to provide mechanical stability. These dots represent soldering or weld points used to mechanically and/or electrically interconnect the devices in series via strip 604. When connected in series as in FIGS. 6 and 7, the LED devices can be powered by a fairly high voltage and can be AC powered since the LED devices also serve as rectifiers.

Figure 8:
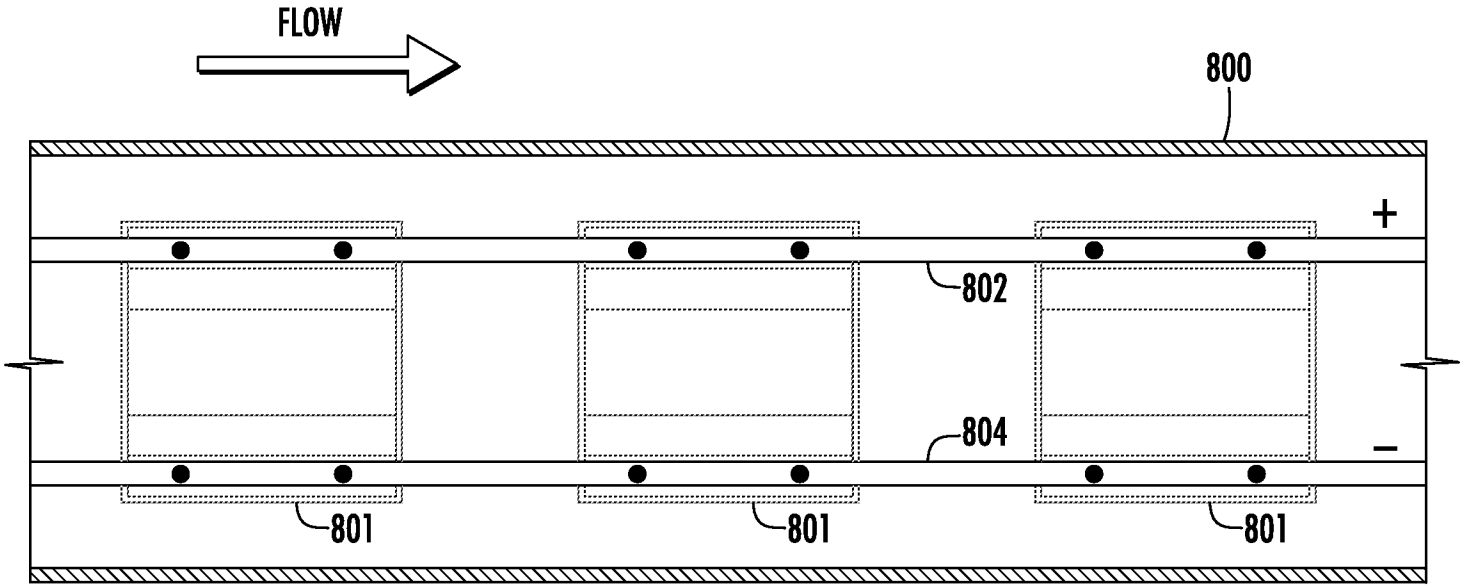
FIG. 8 provides a magnified view of a linear array of LED devices connected in parallel and disposed within an optical envelope according to example embodiments of the invention.

FIG. 8 shows a bottom view of a portion of a tubular optical envelope 800 with a plurality of LED devices 801 included inside according to another embodiment of the present invention. The optical envelope is full of circulating liquid as previously described. Three LED devices are shown in this part of the optical envelope. In this particular example again, all of the LEDs face the same direction, though as mentioned elsewhere a system can be designed in which the LEDs face different directions. The LED devices receive power through metal strips 802 and 804, wherein strip 802 is connected to the positive terminal of the power supply and all LED devices, and strip 804 serves as the negative terminal. Thus, LED devices 801 in this embodiment are connected in parallel. In practice, LED devices 801 can be similar or identical to LED devices 601 pictured in FIGS. 6 and 7, but merely rotated ninety degrees relative to the metal strips and optical envelope of the system.

Still referring to FIG. 8, additional options for a system according to embodiments of the invention are illustrated. Firstly, as can be seen in the drawing, the thickness of the optical envelope of the system is shown exaggerated and includes fill dots to illustrate that the material can be impregnated with phosphor, or a rare-earth compound to provide notch-filtering, as previously discussed. Secondly, in the view of FIG. 8, voltage can be supplied from the right, and the flow of coolant can be from the left, in opposite directions. With such an arrangement, the optically transmissive fluid medium circulates in a direction that opposes a voltage drop through the plurality of LED devices. The voltage drop is caused by the devices further and further away from the power source being connected to the power source by longer and longer lengths and by current drain through the preceding LED devices. In a fixture with a tubular light source, this arrangement causes the LED devices that are running at lower voltages to also be the coolest. These two effects can cancel each other out, since lower voltages typically mean lower currents, which reduce output, while cooler temperatures for LEDs tend to increase output. It should be noted that in any embodiment, as an alternative or in addition to the optically transmissive envelope being impregnated with phosphor as discussed above, phosphor particles can be suspended in the fluid medium. An embodiment could be developed in which phosphor particles are suspended in the fluid medium, and a rare-earth compound is used to impart notch-filtering properties to the optical envelope material.

The effect of the temperature change over the length of a linear fixture as coolant heats, especially if the coolant is circulating relatively slowly can be minimized or eliminated if one has no desire to use the effect to counteract voltage drop. One way to minimize this temperature gradient is by using a reversible pump to circulate the fluid medium, and causing the pump to reverse the fluid circulation direction at regular intervals, or based on temperature sensing. Electronic circuitry to accomplish this task can be included with the driver or other control circuitry in the system, and can also be liquid cooled if desired.

Figure 9B:
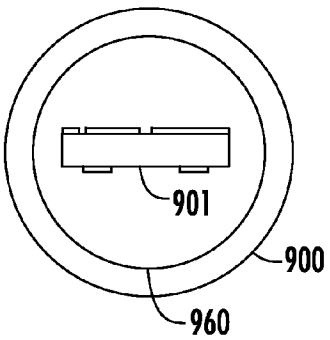
FIG. 9 provides magnified views of a portion of a lighting system according to some embodiments of the invention, with an internal optical envelope, which is in turn inside an optical envelope through which a fluid medium is circulating.
Figure 9A:
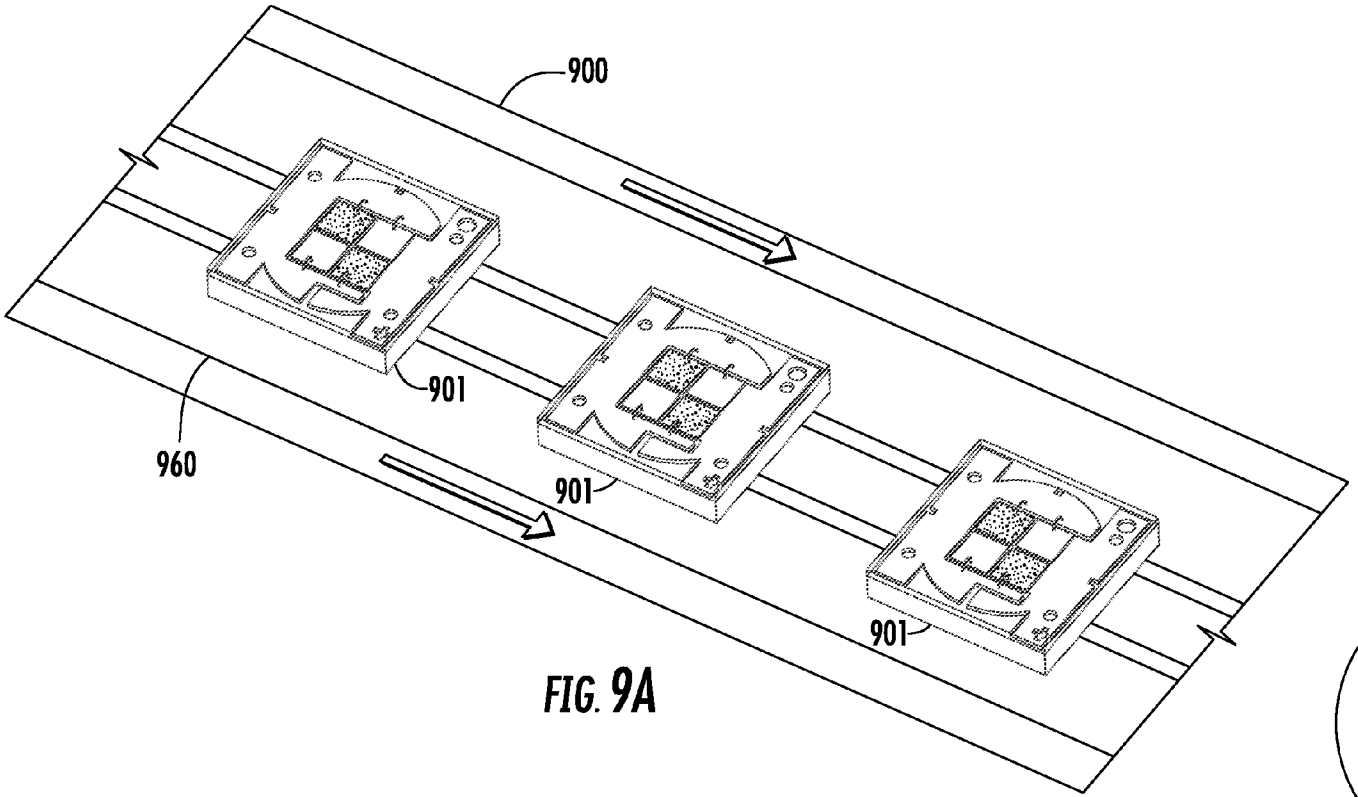

FIG. 9 is presented as two views: FIG. 9A shows a top perspective view of a portion of a lighting system, a tubular optical envelope 900 with a plurality of LED devices 901 included inside, and FIG. 9B shows a cross-sectional view of the same portion sectioned between LED devices. The optical envelope is full of circulating liquid as previously described and as indicated by the arrows in the diagram. Three LED devices are shown in this part of the optical envelope. In this particular example, all of the LEDs face the same direction, though as mentioned elsewhere a system can be designed in which the LEDs face different directions. The LED devices and the way in which they are supplied with power are similar to what has been previously described so further details will not be discussed relative to FIG. 9.

Still referring to FIG. 9, LED devices 901 are further enclosed in an internal envelope 960. The internal envelope can have any or all of the optical properties and use any material previous described. It may include a phosphor, filtering, and/or be diffusive to provide color mixing. In the example embodiment of FIG. 9, internal envelop 960 contains an optically transmissive, insulative fluid medium, which is in direct contact with the LED chips on LED devices 901. In this example embodiment, the fluid in the internal envelope is stationary, but could be made to circulate. A circulating fluid medium is contained in the space between optical envelope 900 and internal envelope 960. Since this fluid is only in contact with optical elements and not the LED devices, it can be conductive and does not need to be inert. In this example embodiment, water is used.

In some embodiments, the LED devices can face different directions, or there can be multiple rows or strings of LED devices to render the linear light source more omnidirectional relative to its axis. These strings of LEDs can be created from individual, possibly transparent chips on a wire structure or lead frame to create a light source that is substantially omnidirectional about a linear axis. With the example given above using multichip, submount-based LED devices, substantial omnidirectional light can be obtained by simply turning some of the devices around to face the opposite direction. Multiple strings of such devices facing different directions can also be included, assuming a large-enough optical envelope.

The various parts of a lighting system of fixture according to example embodiments of the invention can be made of any of various materials. A system or fixture according to embodiments of the invention can be assembled using varied fastening methods and mechanisms for interconnecting the various parts. In some embodiments, combinations of fasteners such as tabs, latches or other suitable fastening arrangements and combinations of fasteners can be used which would not require adhesives or screws. In other embodiments, adhesives, solder joints, welds, screws, bolts, or other fasteners and/or fastening techniques may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lighting system comprising:

a tubular optical envelope;

an array of LED devices without a submount or other carrier within the optically transmissive envelope to be operable to substantially emit omnidirectional light when energized;

an optically transmissive fluid medium in thermal communication with the array of LED devices; and a flow return member in fluid communication with the tubular optical envelope so that the optically transmissive fluid medium can circulate through the optically transmissive envelope, the flow return member further comprising a plurality of metal coils through which the optically transmissive fluid passes, the plurality of metal coils being external to the tubular optical envelope.

2. The lighting system of claim 1 further comprising a thermoelectric cooler in thermal communication with the optically transmissive fluid medium.

3. The lighting system of claim 1 further comprising a pump in fluid communication with at least one of the tubular optical envelope and the flow return member.

4. The lighting system of claim 1 wherein at least one of the optically transmissive envelope and the flow return member is oriented so that the fluid medium circulates by at least one of gravity and temperature difference.

5. The lighting system of claim 1 wherein the optically transmissive fluid medium comprises at least one of oil and a fluorinated or halogenated liquid or gel.

6. The lighting system of claim 5 wherein the optically transmissive fluid medium is an index matching medium.

7. The lighting system of claim 5 further comprising phosphor disposed within or on the tubular optical envelope.

8. The lighting system of claim 7 wherein the tubular optical envelope further comprises neodymium oxide so that the envelope filters light to exhibit a spectral notch between 520 nm and 605 nm.

9. The lighting system of claim 5 wherein the array of LED devices further comprises a plurality of LED devices connected in series.

10. The lighting system of claim 9 wherein the electrical connection is configured to supply the array of LED devices with alternating current.

11. The lighting system of claim 9 wherein the electrical connection is configured to supply the array of LED devices with direct current.

12. The lighting system of claim 1 wherein the optically transmissive fluid medium comprises a phase change material.

13. The lighting system of claim 1 wherein the array of LED devices further comprises a plurality of LED devices connected in parallel.

14. The lighting system of claim 13 wherein the flow return member and optically transmissive envelope are configured so that the optically transmissive fluid medium circulates in a direction that opposes a voltage drop through the plurality of LED devices.

15. The lighting system of claim 1 further comprising:

an internal envelope between the tubular optical envelope and the array of LED devices; and an internal coolant disposed in the internal envelope.

16. The lighting system of claim 15 wherein the internal coolant comprises at least one of oil and a fluorinated or halogenated liquid or gel.

17. The lighting system of claim 16 wherein the optically transmissive fluid medium comprises water.

18. A light fixture comprising:

an optically transmissive tubular envelope;

a linear array of LED devices without a submount or other carrier disposed in the tubular envelope to be operable to substantially emit omnidirectional light when energized;

a reflector configured to reflect the omnidirectional light from the linear array of LED;

an optically transmissive fluid medium in thermal communication with the linear array of LED devices;

a flow return member in fluid communication with the tubular envelope so that the optically transmissive fluid medium can circulate through the tubular envelope, the flow return member further comprising a plurality of metal coils through which the optically transmissive fluid passes, the plurality of metal coils being external to the tubular envelope; and a power supply connected to the linear array of LED devices.

19. The light fixture of claim 18 further comprising a thermoelectric cooler in thermal communication with the optically transmissive fluid medium.

20. The light fixture of claim 18 wherein the optically transmissive fluid medium comprises at least one of oil and a fluorinated or halogenated liquid or gel.

21. The light fixture of claim 20 wherein the optically transmissive fluid medium is an index matching medium.

22. The light fixture of claim 18 wherein the linear array of LED devices further comprises a plurality of LED devices connected in series.

23. The light fixture of claim 18 wherein the linear array of LED devices further comprises a plurality of LED devices connected in parallel.

24. The light fixture of claim 23 wherein the flow return member and optically transmissive tubular envelope are configured so that the optically transmissive fluid medium circulates in a direction that opposes a direction of voltage drop through the plurality of LED devices.

25. A method of operating an LED lighting system, the method comprising:

energizing a linear LED array comprising a plurality of LEDs without a submount or other carrier so that the plurality of LEDs substantially emit omnidirectional light;

circulating an optically transmissive fluid through a tubular optical envelope surrounding the linear LED array so that the LED array substantially emits the omnidirectional light through the optically transmissive fluid medium and the tubular optical envelope; and dissipating heat from the optically transmissive fluid by circulating the optically transmissive fluid medium through a flow return member comprising a plurality of metal coils through which the optically transmissive fluid passes, the plurality of metal coils being external to the tubular optical envelop.

26. The method of claim 25 further comprising energizing a phosphor.

27. The method of claim 26 further comprising filtering a visible light intensity using neodymium oxide so that the intensity is comparatively reduced within a predetermined part of a spectrum of visible light.

28. The method of claim 25 wherein at least one of the circulating of the optically transmissive fluid through the tubular optical envelope and the circulating of the optically transmissive fluid through the flow return member further comprises pumping the optically transmissive fluid.

29. The method of claim 25 wherein the circulating of the optically transmissive fluid through the optical envelope further comprises circulating the optically transmissive fluid in a direction that opposes a voltage drop in the linear LED array.

* * * * *